United States Patent [19]

Meistrick et al.

[11] Patent Number: 4,664,070

[45] Date of Patent: May 12, 1987

[54] HYDRO-MECHANICAL OVERHEAD FOR INTERNAL COMBUSTION ENGINE

[75] Inventors: Zdenek S. Meistrick, Bloomfield; Robert B. Price, Manchester, both of Conn.

[73] Assignee: The Jacobs Manufacturing Company, Bloomfield, Conn.

[21] Appl. No.: 810,088

[22] Filed: Dec. 18, 1985

[51] Int. Cl.[4] ..... F02D 13/04; F02B 69/06

[52] U.S. Cl. ..... 123/21; 123/90.13; 123/321; 123/90.15

[58] Field of Search ..... 123/21, 90.12, 90.13, 123/90.15, 90.16, 321, 322

[56] References Cited

U.S. PATENT DOCUMENTS

| | | | |
|---|---|---|---|
| 2,178,152 | 10/1939 | Walker | 123/97 |
| 2,785,668 | 3/1957 | Dehmer | 123/97 |
| 3,220,392 | 11/1965 | Cummins | 123/97 |
| 3,367,312 | 2/1968 | Jonsson | 123/97 |
| 3,786,792 | 1/1974 | Pelizzoni et al. | 123/97 B |
| 3,809,033 | 5/1974 | Cartledge | 123/90.46 |
| 3,859,970 | 1/1975 | Dreisin | 123/97 B |
| 4,000,756 | 1/1977 | Ule et al. | 137/596.17 |
| 4,009,695 | 3/1977 | Ule | 123/90.13 |
| 4,174,687 | 11/1979 | Fuhrmann | 123/90.13 |
| 4,502,425 | 3/1985 | Wride | 123/90.12 |
| 4,510,900 | 4/1985 | Quenneville | 123/90.12 |
| 4,572,114 | 2/1986 | Sickler | 123/21 |
| 4,592,319 | 6/1986 | Meistrick | 123/90.12 |

*Primary Examiner*—Ira S. Lazarus

*Attorney, Agent, or Firm*—Donald E. Degling

[57] ABSTRACT

An hydromechanical overhead is provided for a four-cycle internal combustion engine. The hydromechanical overhead includes a set of master cylinders and pistons adapted to be actuated by each of the engine exhaust and intake pushtubes, a set of slave cylinders and pistons adapted to actuate each exhaust and intake valve, a two-position three-way control valve associated with each slave cylinder, passageways interconnecting the several master and slave cylinders and control valves and electronic control means adapted to move the control valves between a first position wherein the engine operates in a four-cycle powering mode and a second position wherein the engine operates in a two-cycle retarding mode. A solenoid controlled lash adjustment mechanisn is provided for the exhaust and intake valves whereby the normal lash required for the powering mode of engine operation may automatically be increased to the substantially larger lash required for the two-cycle retarding mode of engine operation.

10 Claims, 11 Drawing Figures

V
CK
2A

64(1)
28(1)
66
18
16
68
28(3)
28(4)
70
20
22
28(6)
28(1)
64(5)
28(5)
52
54
V
CK
50
48
28(1)
28
28(6)
64(2)
28(2)
53
79
47
77
49
75
83
85
81
51
67
55
45
71
73
57
61
65
59
42
30
44
87
34
32
35
43
63
69
40
41
46
38
36
28(1)
2C
28(4)
64(1)
28(3)
2C

72(1)
74
28(1)
76
78
18'
16'
28'(6)
20'
22
28'(6)
72(6)
28'(1)
52
54
V
CK
50
48
72(1)
3A
28'(1)
81'
53'
77'
75'
47'
85'
83'
79'
55'
28'
45'
71'
69'
67'
73'
57'
51'
44'
30'
63'
89'
34'
32'
35
65'
42'
59'
40'
41'
43'
36
38

3C
3C
V
CK

VALVE OPENING SCHEDULE

HYDRO-MECHANICAL OVERHEAD FOR INTERNAL COMBUSTION ENGINE

FIELD OF THE INVENTION

This invention relates generally to compression release engine retarders for use on internal combustion engines. More particularly the present invention relates to an hydro-mechanical overhead for an internal combustion engine which operates the exhaust and intake valves in the conventional sequence during the powering mode of the engine but modifies the valve sequence during the retarding mode of operation to produce a compression release event during each crankshaft revolution for each engine cylinder.

PRIOR ART

For many years, four-cycle internal combustion engines have been provided with a mechanical mechanism to operate the intake and exhaust valves in the desired sequence. This mechanism commonly takes the form of a camshaft synchronized with the engine crankshaft by gears or a timing chain so as to rotate at one half the speed of the engine crankshaft. A set of cams is affixed to the camshaft and contacts the valve stems, or rocker arms and pushtubes associated with the valve stems, so as to open each exhaust and intake valve as required for proper engine operation. Where the engine employs a four-stroke cycle including an intake stroke, a compression stroke, a power stroke and an exhaust stroke, it will be appreciated that the intake valve and the exhaust valve for each cylinder of the engine open once during every two crankshaft revolutions.

Although the early internal combustion engines employed valve train mechanisms that were entirely mechanical, later improvements included hydraulic valve lifters and, in some cases, an hydraulic mechanism in place of the mechanical mechanism.

Engine retarders of the compression release type are also now well-known in the art and are commonly used to augment the service brakes on commercial vehicles. Such engine retarders are designed to convert, temporarily, an internal combustion engine of the compression ignition type into an air compressor so as to develop a retarding horsepower which may be a substantial portion of the operating horsepower developed by the engine.

The compression release engine retarder of the type disclosed in Cummins U.S. Pat. No. 3,220,392 employs an hydraulic system wherein the motion of a master piston controls the motion of a slave piston which, in turn, opens the exhaust valve of the internal combustion engine near the end of the compression stroke whereby the work done in compressing the intake air is not recovered during the expansion or "power" stroke but, instead, is dissipated through the exhaust and cooling system of the vehicle. The master piston is customarily driven by a pushtube controlled by a cam on the engine camshaft which may be associated with the fuel injector of the cylinder involved or with the intake or exhaust valve of another cylinder.

One of the advantages of the compression release retarder of the type disclosed in the Cummins U.S. Pat. No. 3,220,392 is that it may be incorporated into an existing engine without redesign or reconstruction of the engine. This advantage distinguishes the Cummins type retarder from other compression release retarders which require extra cams or cam profiles (see Pelizzoni U.S. Pat. No. 3,786,792; Dreisin U.S. Pat. No. 3,859,970; Jonsson U.S. Pat. No. 3,367,312, and Cartledge U.S. Pat. No. 3,809,033.)

Compression release engine retarders have also been combined with hydraulic valve actuating mechanisms. An example of such an arrangement is shown in Fuhrmann U.S. Pat. No. 4,174,687 wherein the hydraulic system is driven from the engine camshaft. By means of appropriate valving the valve actuating system may be converted from a powering mode to a retarding mode.

Each of the retarding systems cited above discloses a standard four-cycle engine and a fourcycle retarder, i.e., the retarder produces one compression release event per cylinder for every two revolutions of the crankshaft.

A further development appears in Uhl U.S. Pat. No. 4,009,695 and Uhl et al. U.S. Pat. No. 4,000,756. Each of these patents discloses the so-called "electronic camshaft" wherein a valve timing computer controls the operation of a solenoid actuated hydraulic valve mechanism thereby eliminating the camshaft, cams, pushtubes and rocker arms. Uhl U.S. Pat. No. 4,009,695 describes a number of engine operating modes including a deceleration mode wherein the engine functions as an air compressor. In this mode, the intake valves are maintained in the closed position and gas is drawn from the exhaust manifold, compressed and returned to the exhaust manifold.

More recently, in Sickler U.S. application Ser. No. 728,947 filed Apr. 30, 1985 now U.S. Pat. No. 4,572,114 and assigned to the assignee of the present application an hydromechanical mechanism is disclosed which enables a four-cycle internal combustion engine to produce one compression release event per cylinder per crankshaft revolution when operating in the retarding mode.

In recent years, commercial vehicle operators have become acutely aware of rising fuel and other operating costs and have sought to reduce fuel costs by operating the vehicle's engine at lower speeds and consequently fewer engine crankshaft revolutions per minute ("rpm"). Although effective for the purpose of fuel conservation, such practice limits the retarding horsepower which may be developed by the compression release engine retarder since the retarding horsepower varies directly with engine speed. There is therefore a need to increase the retarding horsepower produced by the retarder to compensate for the lost retarding horsepower resulting from the lower engine speed.

SUMMARY OF THE INVENTION

Commercial vehicles which frequently need, and are supplied with, compression release engine retarders generally employ compression ignition engines having a four-stroke cycle. When such engines are fitted with compression release engine retarders, the retarders also operate on a four-stroke cycle. Recently, applicants' assignee has developed an hydro-mechanical mechanism for disabling certain of the valve actions and varying the openings of the valves so as to provide, during retarding, a two-cycle mode of operation. In so doing, the number of compression release events per unit of time is doubled and the retarding horsepower developed by the engine is increased substantially.

The present invention represents a further development of the two-cycle retarding concept wherein the hydro-mechanical valve actuating mechanism is simplified and the usual rocker arm mechanism for valve actuation eliminated. An electronically controlled hydro-mechanical overhead is provided which operates the valves in a four-stroke cycle during the powering mode and a two-stroke cycle during the retarding mode. The shift in mode of operation is controlled manually or electronically by means of two-position control valves.

BRIEF DESCRIPTION OF THE DRAWINGS

Further objects and advantages of the present invention will become apparent from the following detailed description of the invention and the drawings in which.

DETAILED DESCRIPTION OF THE INVENTION

Internal combustion engines of the compression ignition type used for commercial vehicles commonly employ four or six cylinders and have intake and exhaust valves which are mechanically driven from cams formed on a camshaft. Where overhead valves are provided, pushtubes (or pushrods) and rocker arms are interposed between the cams and valve stems.

For many years, hydro-mechanical systems have been used to open the exhaust valve near the end of the compression stroke so as to provide a compression release retarding mode of operation. In such a system, the hydro-mechanical elements are commonly driven from the engine cams or pushtubes.

In accordance with the present invention, an apparatus is disclosed wherein the usual rocker arm mechanism is eliminated and an hydro-mechanical apparatus is employed to perform both the valve action required in the normal powering mode and the different valve action required to operate in a two-cycle retarding mode.

Figure 1:
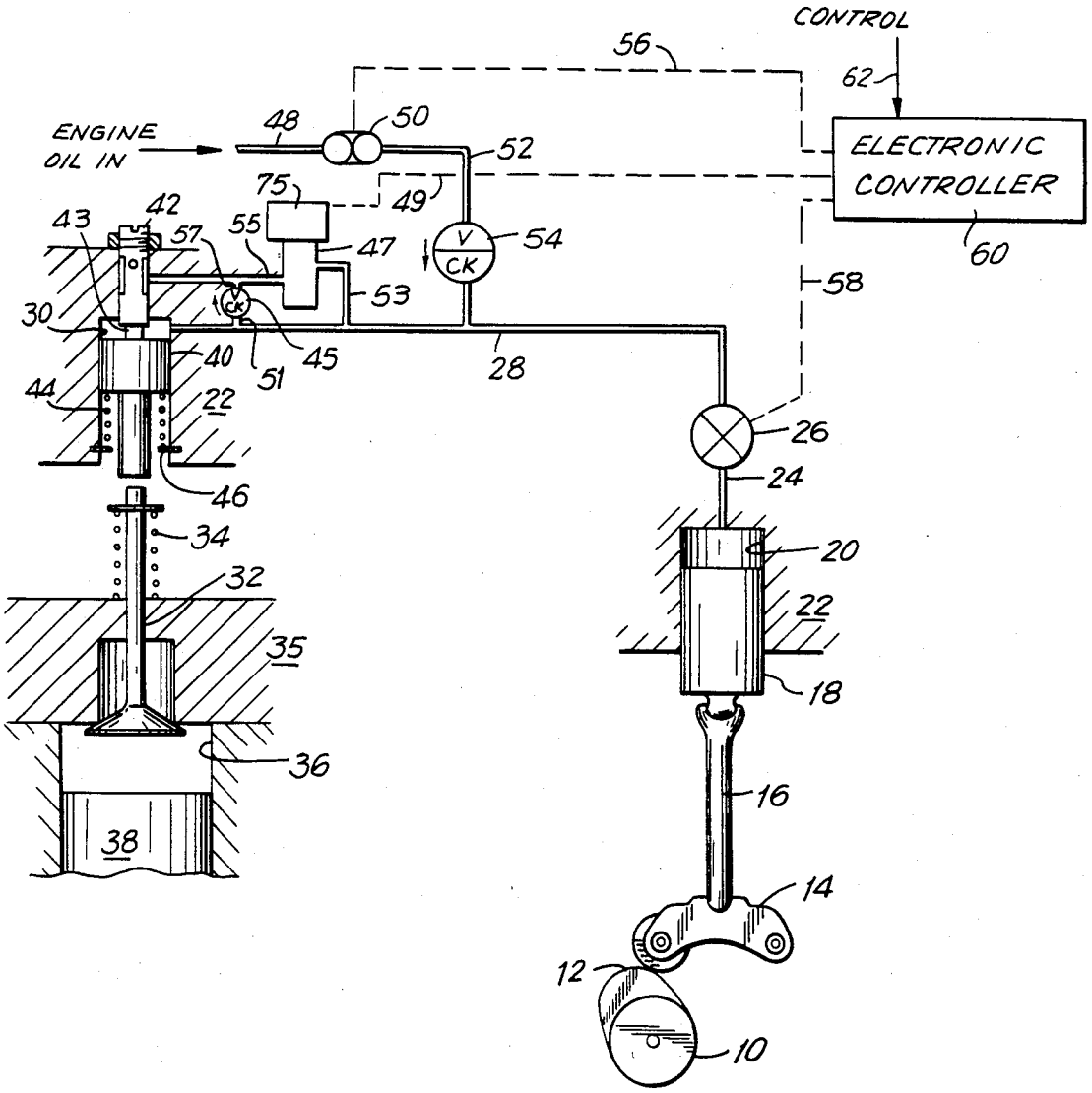
FIG. 1 is a schematic diagram according to the present invention showing the general arrangement of the hydraulic valve control circuit for the intake and exhaust valves.

Reference is now made to FIG. 1 which shows the hydro-mechanical circuit which operates the intake or the exhaust valves during both the powering and the retarding mode of operation. The engine camshaft 10 is driven from the engine crankshaft (not shown) in a conventional manner so as to rotate the camshaft at one-half the speed of the crankshaft. The camshaft 10 has formed thereon a plurality of cams 12 which drive associated cam followers 14. The cam followers 14 may be of any well-known type of follower including flat-faced followers, mushroom followers, roller followers or, as shown in FIG. 1, an oscillating roller follower. Each cam follower 14, in turn, drives a pushtube 16 which causes a master piston 18 to reciprocate within a master cylinder 20 formed in an hydraulic overhead 22. A cam 12, cam follower 14, pushtube 16 and master piston 18 is provided for the intake and for the exhaust valve associated with each cylinder of the engine. If the engine has camshaft-driven fuel injectors, a similar master piston mechanism may be provided for each injector or the conventional mechanical system can be used. It will be understood that the hydraulic overhead 22 carries the master and slave cylinders and pistons and the hydraulic circuits associated with each intake and exhaust valve. If desired, hydraulic circuits for operating the fuel injectors may also be provided in the hydraulic overhead 22.

A first passageway 24 communicates between the master cylinder 20 and a control valve 26. A second passageway 28 communicates between the control valve 26 and a slave cylinder 30 formed in the hydraulic overhead 22 and aligned with an engine valve 32 (which may be either an intake or an exhaust valve). The engine valve 32 is of conventional design and is normally biased to a closed position by a compression spring 34. The valve 32 is mounted in the cylinder head 35 and is adapted to open the engine cylinder 36 to either the exhaust or the intake manifold, as the case may be. The engine piston 38 reciprocates within the cylinder 36 in a conventional manner.

A slave piston 40 is mounted for reciprocating motion within the slave cylinder 30 and is biased toward its rest position against an adjustable stop 42 by a compression spring 44 which seats against a snap ring 46 mounted in the wall of the slave cylinder 30. The adjustable stop 42 is set to provide sufficient clearance or "lash" in the valve train mechanism so that when the engine is hot and the stem of the valve 32 expands the valve may still close tightly. A clearance on the order of 0.018 inch when the engine is cold is generally adequate.

The adjustable stop 42 includes an automatic hydraulic lash adjustment mechanism 43 controlled by a check valve 45 and a solenoid valve 47. The solenoid valve 47 is activated by the electronic controller 60 through conduit 49.

Hydraulic fluid, which may comprise oil from the engine crankcase (not shown), is directed through a duct 48, a low-pressure pump 50, and a duct 52 to the passageway 28. A check valve 54 is interposed in the duct 52. The pump 50 and the control valve 26 are controlled by electrical signals through the conduits 56, 58 respectively, said signals being generated by the electronic controller 60. The electronic controller 60 may be actuated by a control signal 62 resulting from closing the throttle, depressing the service brake pedal, or some other manual or automatic control.

The check valve 45 and solenoid valve 47 communicate with passageway 28 respectively through passageways 51 and 53, while a passageway 55 interconnects the solenoid valve 47 and the lash adjustment mechanism 43 and a passageway 57 interconnects the check valve 45 and the passageway 55.

The operation of the mechanism is as follows: When the pump 50 is actuated and the control valve 26 is positioned so that passageways 24 and 28 are in communication, oil will be pumped through duct 52, the check valve 54, and passageways 24 and 28 so as to fill the slave cylinder 30 and the master cylinder 20. Thereafter, when the master piston 18 is driven upwardly (as shown in FIG. 1) by the cam 12, follower 14 and pushtube 16, the slave piston 40 will be driven downwardly to open the valve 32. The function of the lash adjustment mechanism 43, the check valve 45 and the solenoid valve 47 will be described in greater detail below with respect to FIGS. 2 and 3. Hydro-mechanical mechanisms as shown in FIG. 1 are provided for the exhaust and intake valves for each cylinder of the engine. Of course if the engine is provided with dual intake or exhaust valves, the dual valves may be interconnected by an appropriate crosshead and opened by a single slave piston 40.

Reference is now made to FIGS. 2, 2A, 2B, and 2C which show the interconnection between the several exhaust valve opening circuits of a six cylinder engine which are required to provide the powering and retarding modes of operation for engine Cylinder No. 1 of such an engine.

The exhaust control valve 64(1) for the exhaust valve (FIGS. 2 and 2A) may comprise a cylindrical body portion 66 sized to seat within the master cylinder 20 and rotate through an angle of, for example, 180°. A control portion 68 extends through the hydraulic overhead 22. Conventional solenoid means (not shown) may be employed to rotate the body portion 66 of the valve between its two extreme positions. Within the body portion 66 of the valve is an L-shaped passageway 70 which communicates at one end with the master cylinder 20 and, at the other end, with the selected passage 28(1) or passages 28(3) and 28(4) leading respectively to one or two slave cylinders 30.

Figures 2, 2A:
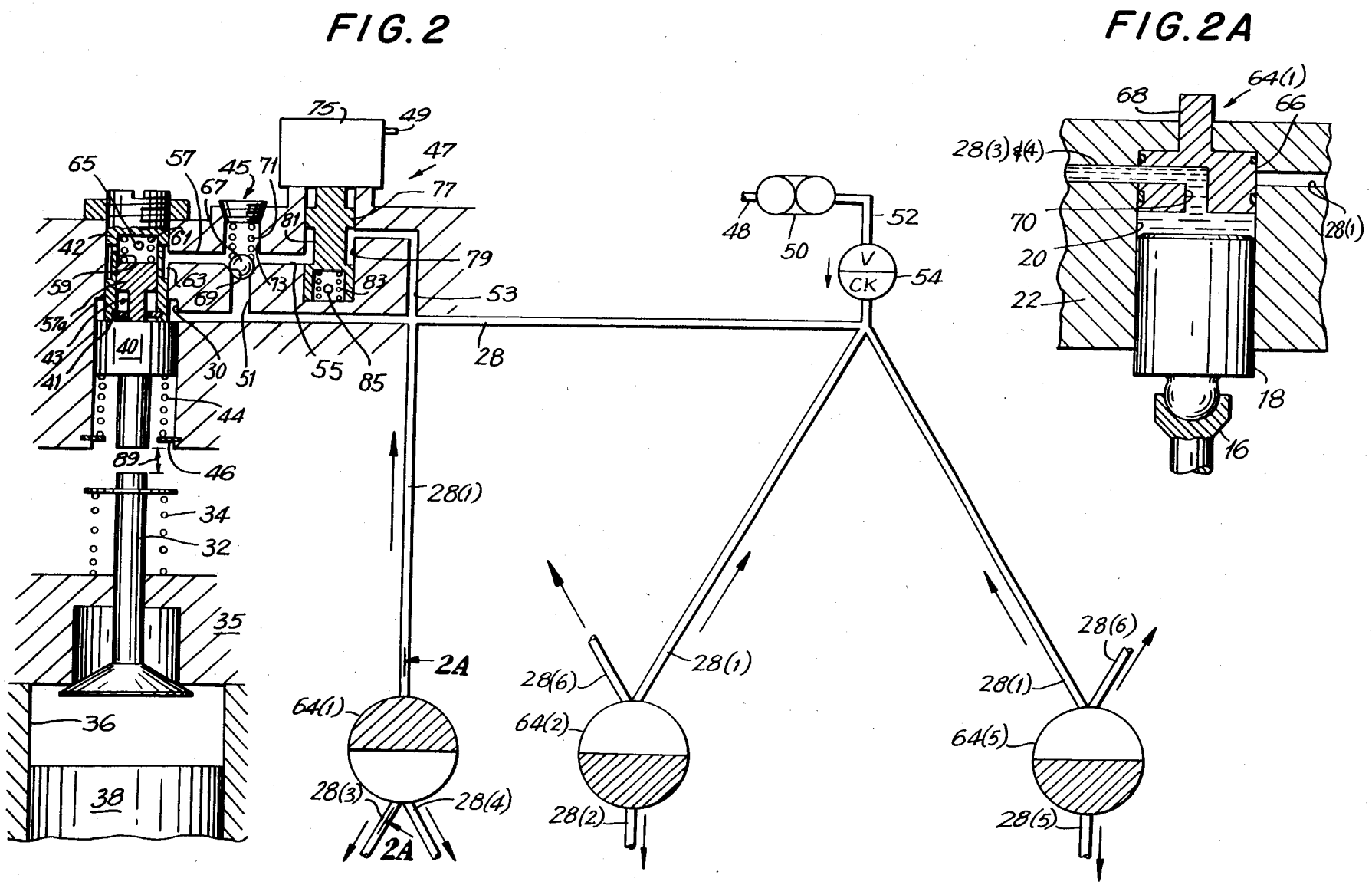
FIG. 2 is a schematic diagram according to the present invention showing the hydraulic control circuit for an exhaust valve in the retarding mode of operation.
FIG. 2A is a cross-sectional view of a control valve for an exhaust valve taken along line 2A—2A of FIG. 2.
Figures 2B, 2C:
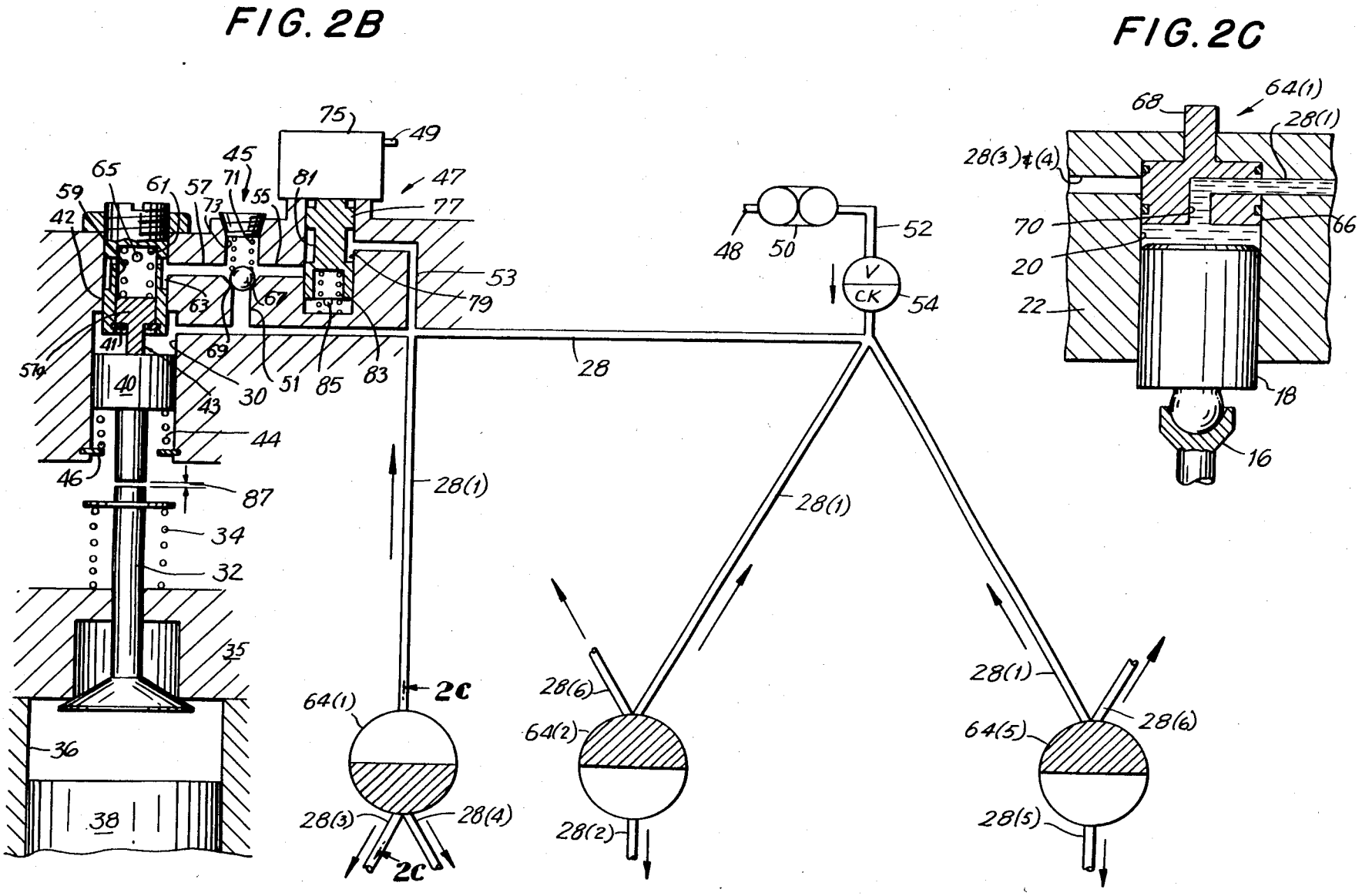
FIG. 2B is a schematic diagram according to the present invention showing the hydraulic control circuit for an exhaust valve in the powering mode of operation.
FIG. 2C is a cross-sectional view of a control valve for an exhaust valve taken along line 2C—2C of FIG. 2B.

In FIGS. 2 and 2B, the engine cylinder 36 is Cylinder No. 1, the valve 32 is the exhaust valve for Cylinder No. 1 and the master piston 18 (FIGS. 2A and 2C) and exhaust control valve 64(1) are interconnected therewith by passageway 28(1).

FIGS. 2 and 2A show the hydraulic circuits for the exhaust valve of Cylinder No. 1 when the control valve 64(1) is set to the retarding position and the solenoid valve 47 is energized. FIGS. 2B and 2C show the hydraulic circuit for the exhaust valve of Cylinder No. 1 when the control valve 64(1) is set to the powering position and the solenoid valve 47 is not energized.

As will be explained in more detail below, for a conventional 4-cycle engine operating in a powering mode and having the firing order 1-5-3-6-2-4, a conventional firing order for a six cylinder engine, the exhaust valve for Cylinder No. 2 will normally be open when the piston in Cylinder No. 1 is at TDC following a compression stroke. Similarly, the exhaust valve for Cylinder No. 5 will normally be open when the piston in Cylinder No. 1 is at TDC following an exhaust stroke. In order to provide a two-cycle retarding mode of operation the exhaust valve 32 must be opened each time the piston 38 approaches the top dead center (TDC) position. Thus, with respect to the opening of the exhaust valve at TDC, Cylinder No. 1 is related to the exhaust cam operation of Cylinder Nos. 2 and 5. The relationships of all of the engine cylinders for the retarding mode are summarized in Table 1, below and illustrated in FIG. 5.

TABLE 1

| Compression Release In Cylinder No. | Exhaust Cams Providing Compression Release Motion of (Cyl. No.) |
|---|---|
| 1 | 2, 5 (First/Second Release) |
| 2 | 3, 4 (First/Second Release) |
| 3 | 1, 6 (First/Second Release) |
| 4 | 6, 1 (First/Second Release) |
| 5 | 4, 3 (First/Second Release) |
| 6 | 5, 2 (First/Second Release) |

Referring to FIGS. 2 and 2A, the body portion 66 of each exhaust control valve, e.g. valve 64(1) for cylinder No. 1 where (1) means cylinder No. 1, has two operating positions (1) wherein the L-shaped passageway 70 communicates with the passageway 28(1) leading to the slave cylinder 30 associated with the same engine cylinder as that with which the control valve 64(1) is associated and (2) wherein the L-shaped passageway 70 communicates with two passageways 28(3) and 28(4) leading to the slave cylinders associated with engine Cylinders Nos. 3 and 4, respectively. Similarly, the exhaust control valve 64(2) associated with the master piston for the exhaust valve of Cylinder No. 2 communicates during the powering mode through passageway 28(2) to the slave cylinder associated with the exhaust valve for Cylinder No. 2 and, during the retarding mode, through passageways 28(6) and 28(1) to the slave cylinder associated with the exhaust valves for Cylinder Nos. 6 and 1. Finally, the exhaust control valve 64(5) associated with the master piston for the exhaust valve of Cylinder No. 5 communicates, during the powering mode, through passageway 28(5) to the slave cylinder associated with the exhaust valve for Cylinder No. 5 and, during the retarding mode, through passageways 28(1) and 28(6) to the slave cylinders associated with the exhaust valves for Cylinders Nos. 1 and 6.

Figure 5:
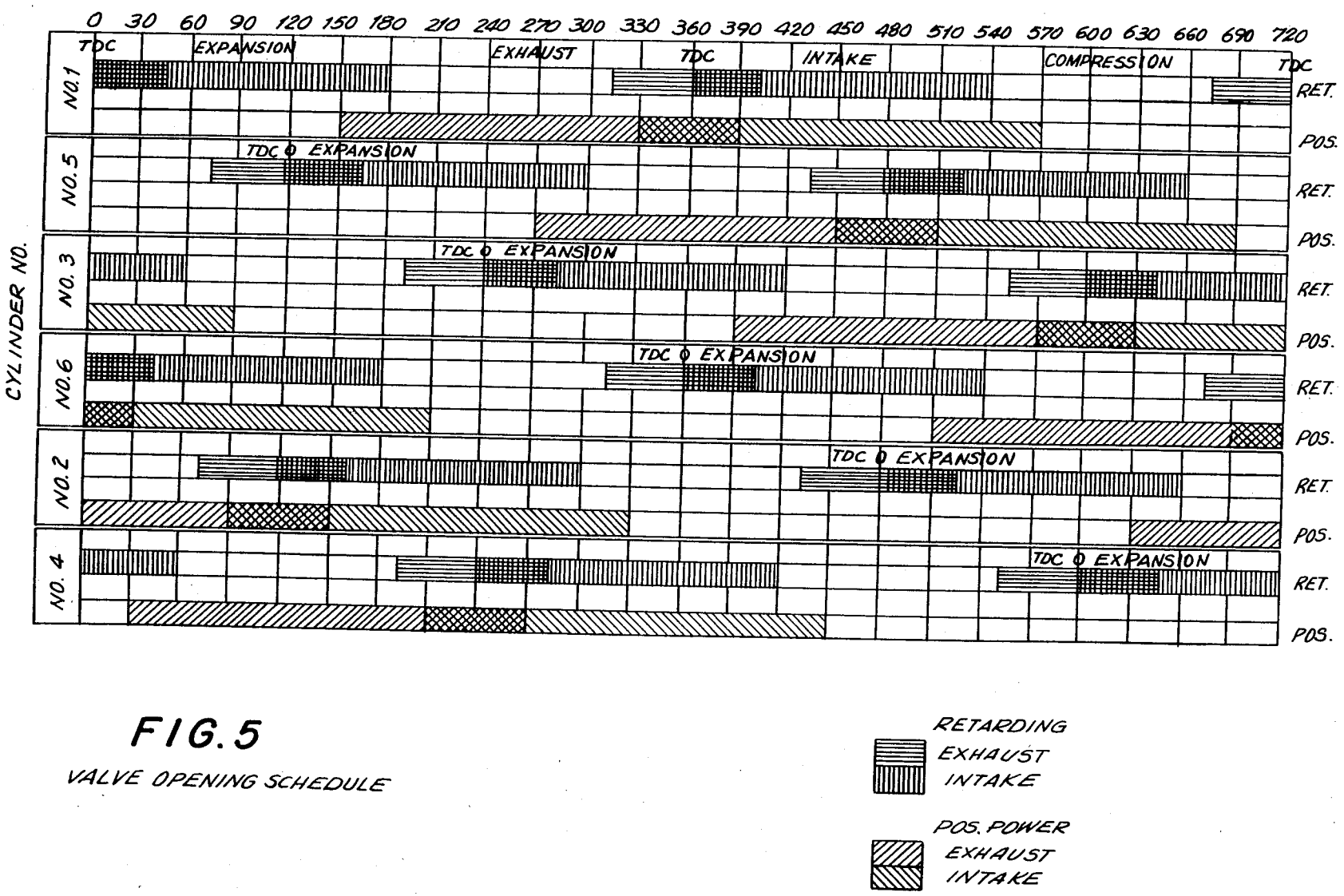
FIG. 5 is a diagram showing the valve opening schedule for a six cylinder engine in both the retarding and the powering modes of operation.

The interconnections among the remaining control valves 64 and slave cylinders 30 will be apparent to those skilled in the art by reference to Table 1 and FIG. 5. While rotatable exhaust control valves 64 have been illustrated in FIGS. 2, 2A, 2B, and 2C it will be appreciated that other types of three-way valves, such as spool valves, may also be employed. Also, since the exhaust control valves are operated in synchronism, they may be electrically or mechanically interconnected and actuated by a single electrical or mechanical controller.

Figure 4:
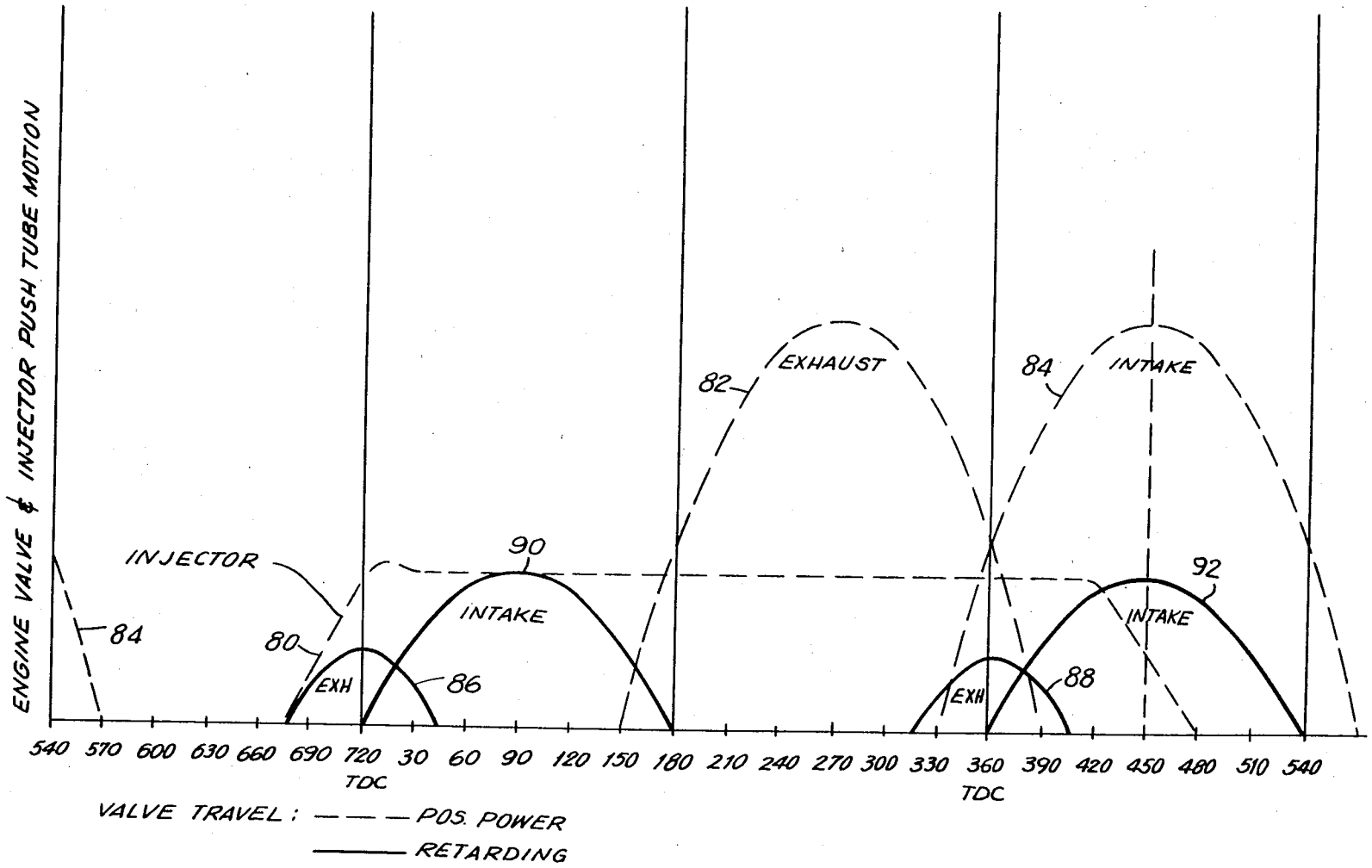
FIG. 4 is a graph showing, in solid lines, the valve opening schedule for Cylinder No. 1 during a retarding mode of operation and, in dashed lines, the valve opening schedule for Cylinder No. 1 during a powering mode of operation.

Reference is now made to FIG. 4 which comprises a diagram showing the valve opening schedule for Cylinder No. 1 both for the powering mode and the two-cycle retarding mode of engine operation. The abscissa is crank angle position in degrees measured from the TDC position of the piston for Cylinder No. 1 following the compression stroke. The ordinate is engine valve or injector pushtube motion. Curve 80 represents the typical motion of the engine fuel injector pushtube for a Cummins engine and is provided for reference only. The fuel injector may be operated in a conventional manner or by a hydro-mechanical mechanism substantially like that shown in FIG. 1. Curve 82 represents the typical motion of the exhaust valve during a powering mode of operation. Similarly, curve 84 represents the typical motion of the intake valve during a powering mode of operation. It will be understood that in the powering mode of operation, each of the intake and exhaust master cylinders is connected by a passageway 28 to the corresponding intake or exhaust slave cylinder as shown in FIG. 1.

When the exhaust control valves 64 are moved to the position for the retarding mode of operation, hydraulic fluid from the exhaust valve master cylinders for Cylinder Nos. 2 and 5 is directed to the exhaust valve slave cylinder for Cylinder No. 1. The motion of the exhaust valve master piston for Cylinder No. 2 opens the exhaust valve for Cylinder No. 1 as indicated by curve 86. Similarly the motion of the exhaust valve master piston for Cylinder No. 5 opens the exhaust valve for Cylinder No. 1 as indicated by curve 88. It will be appreciated that, due to the position of the control valve for Cylinder No. 1 (i.e., valve 64(1)), motion of the master piston for the exhaust valve of Cylinder No. 1 will not result in any motion of the exhaust valve for Cylinder No. 1 and, hence, the valve motion indicated by curve 82 of FIG. 4 does not occur during the retarding mode of operation. It will also be noted that curves 86 and 88 which represent the actual motion of the exhaust valve during the retarding mode of operation indicate substantially less motion of the exhaust valve than is shown by curve 82 which represents the motion of the exhaust valve during the powering mode of operation. This will be discussed in more detail hereafter.

In the two-cycle retarding mode of operation, the intake valves must be operated on a different schedule than in the powering mode since there should be an intake event preceding each compression release event. One intake event may correspond to the normal powering mode operation while the second intake event should occur 360 crank angle degrees later (or earlier). The intake events thus occur each time a piston is moving away from TDC. During the powering mode of operation of a six cylinder engine having the conventional firing order 1-5-3-6-2-4, the pistons in Cylinder Nos. 1 and 6 move in tandem but 360° out of phase so that when the piston in Cylinder No. 1 is in its compression stroke, the piston in Cylinder No. 6 is in its exhaust stroke. Cylinder Nos. 2 and 5 and Cylinder Nos. 3 and 4 are similarly paired. It will be understood, therefore, that the master pistons for the intake valves for Cylinders Nos. 1 and 6 should be interconnected for the retarding mode but separate for the powering mode. Similarly, the master pistons for the intake valves for Cylinder Nos. 2 and 5 should be interconnected for the retarding mode but separate for the powering mode. Finally the master pistons for the intake valves for Cylinder Nos. 3 and 4 should be interconnected for the retarding mode but separate for the powering mode.

Figures 3, 3A:
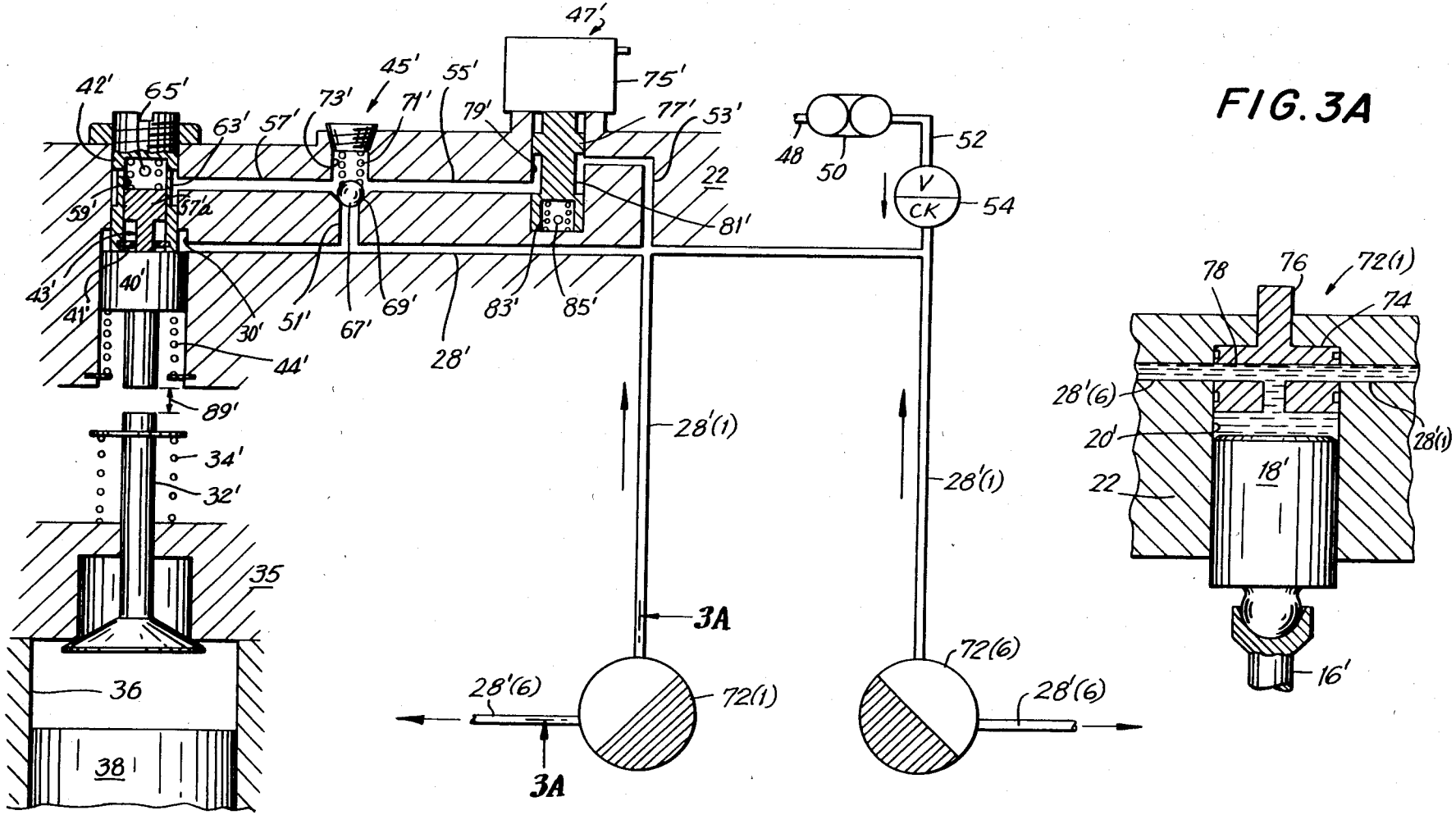
FIG. 3 is a schematic diagram according to the present invention showing the hydraulic control circuit for an intake valve in the retarding mode of operation.
FIG. 3A is a cross-sectional view of a control valve for an intake valve taken along line 3A—3A of FIG. 3.
Figures 3B, 3C:
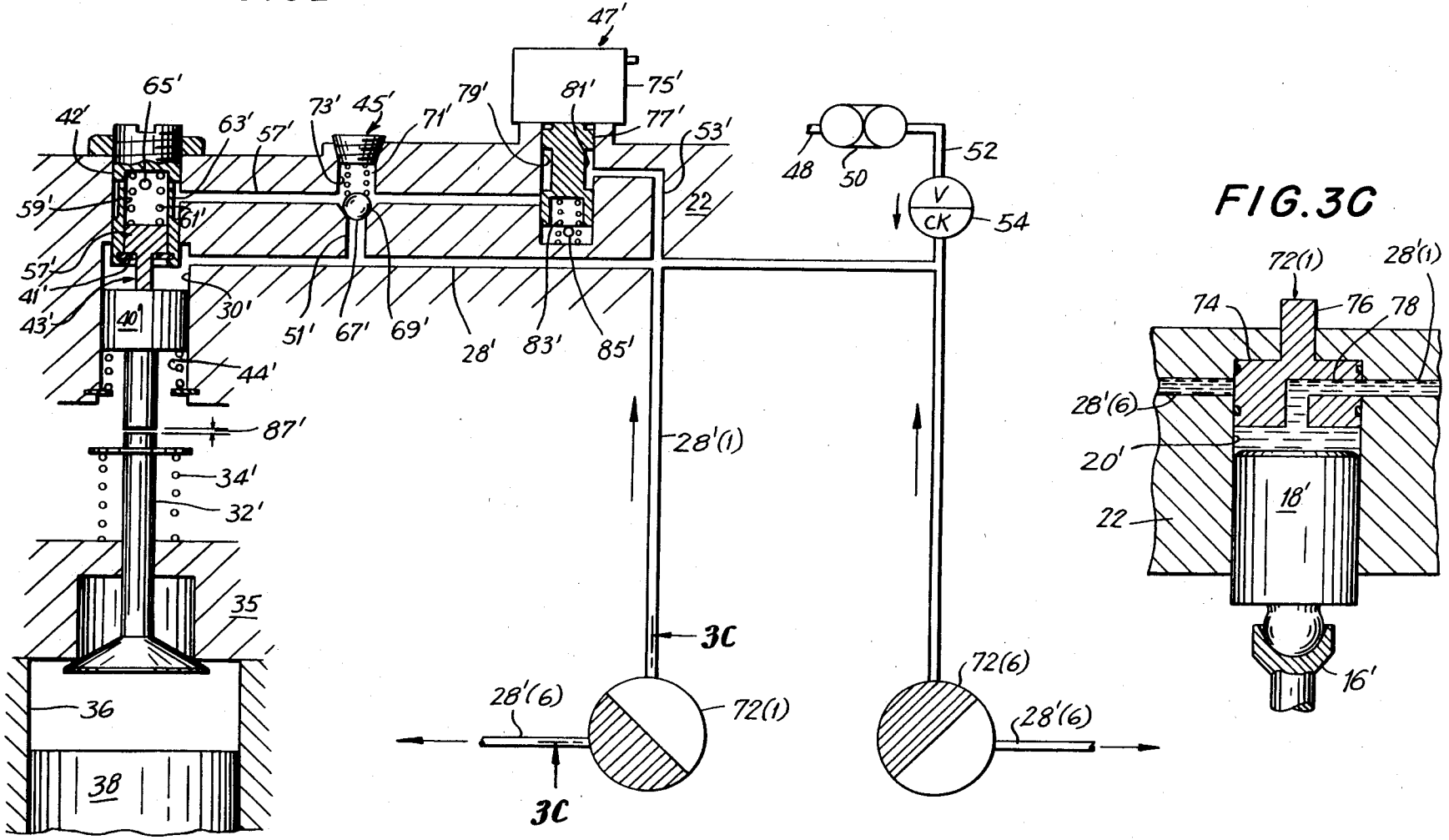
FIG. 3B is a schematic diagram according to the present invention showing the hydraulic control circuit for an intake valve in the powering mode of operation.
FIG. 3C is a cross-sectional view of a control valve for an intake valve taken along line 3C—3C of FIG. 3B.

Reference is now made to FIGS. 3, 3A, 3B and 3C which show the hydraulic circuits required to operate the intake valves in both the powering mode (FIGS. 3B and 3C) and the retarding mode (FIGS. 3 and 3A). Parts which are common to FIGS. 2 and 3 are given the same designation and their description will not be repeated. A prime (') has been used to identify parts associated with an intake valve as distinguished from the similar parts associated with an exhaust valve in FIGS. 2 through 2C. The intake control valve 72 may comprise a cylindrical body portion 74 sized to seat in the master cylinder 20' and rotate through an angle of, for example, 90° and a control portion 76 by which the valve may be rotated to either of its operating positions. A passageway 78 having three adjoining legs is formed in the body portion 74. One leg of passageway 78 communicates with the master cylinder 20'. The second and third legs of passageway 78 may be separated radially by, for example, 90° of arc so as to communicate, for example, with passageways 28'(6) and 28'(1), both of which communicate with the master cylinder 20' but which are separated by, for example, 90° of arc (see FIGS. 3 and 3B). It will be understood that when the control valve 72(1) is rotated through 90° of arc only passageway 28'(1) will communicate with the master cylinder 20' with which control valve 72(1) is associated (see FIGS. 3B and 3C). Similarly, control valve 72(6) associated with the intake valve for Cylinder No. 6, may be rotated from a first position where its master cylinder 20' communicates through passageways 28'(1) and 28'(6) to the slave cylinder 30' associated with the intake valves for Cylinder Nos. 1 and 6 (FIG. 3) to a second position where it communicates only through passageway 28'(6) to the slave cylinder associated with the intake valve for Cylinder No. 6 (FIG. 3B).

The intake valves 32' are provided with a clearance mechanism comprising a lash adjustment mechanism 43', a check valve 45' and a solenoid valve 47' which is mechanically similar to the clearance mechanism referred to above for the exhaust valves.

Intake control valves 72 may be mechanically or electrically interconnected and operated by a single controller. As with the exhaust control valves 64, spool type or sliding type two-position three-way valves may be provided.

The height of curves 86 and 88 (FIG. 4), which represent the travel of the exhaust valve for Cylinder No. 1 due to the motion of the master pistons for Cylinders No. 2 and 5 respectively, is less than the height of curve 82 for two reasons. First, the hydraulic fluid displaced by each master piston during the retarding mode of operation is divided between two exhaust valve slave cylinders and therefore the exhaust valve travel is reduced by about one half. This is advantageous because the exhaust valve opening occurs near the top dead center position of the piston where minimum clearance between the exhaust valve and piston occurs. However, even about half of the normal exhaust valve travel will result in interference between the exhaust valve and the piston at TDC. Moreover, it is necessary to adjust the exhaust valve timing to optimize the compression release event. Thus, it is necessary to provide increased clearance or "lash" in the valve train mechanism during the retarding mode of operation which is automatically reduced to the normal clearance or "lash" when the engine resumes the powering mode of operation. A mechanism to accomplish this result is shown in FIGS. 2 and 2B and comprises a solenoid valve 47, a check valve 45 and a lash adjustment mechanism 43 together with interconnecting passageways.

The lash adjusting mechanism 43 comprises a piston member **57*a* which is mounted for reciprocation within a bore 59 formed in the adjustable stop 42. A compression spring 61 biases the piston member 57*a* toward an extended position wherein the tip of the piston member extends beyond the end of the adjustable stop 42. The piston member 57*a* is retained in the bore 59 by a snap ring 41 mounted in the wall of the bore 59. An annular groove 63 is formed in the outer surface of the adjustable stop 42. The annular groove 63 is sufficiently wide so as to register with passageway 57 throughout the range of adjustment of the stop 42. Annular groove 63 communicates with the bore 59 through a series of holes 65**.

Check valve 45 is located at the juncture of passageways 51, 55 and 57 and comprises a ball valve 67 biased against a seat 69 formed in passageway 51 by a compression spring 71. The compression spring 71 is located in bore 73 formed in the housing 22 coaxially with the passageway 51. The bore 73 may be closed by a plug.

The solenoid valve 47 comprises a solenoid coil 75 energized by the electronic controller 60 through conduit 49 and spool 77 which reciprocates in a bore 79 formed in the housing 22. An annular groove 81 is formed on the outer surface of the spool 77 and communicates in its open or energized position with the passageways 53 and 55 (FIG. 2). The spool 77 is biased by a compression spring 83 towards its closed or deenergized position (see FIG. 2B). In the closed position, communication between the conduits 53 and 55 is interrupted. A vent hole 85 leads to the engine sump (not shown) to provide a drainage path for any oil which leaks past the spool 77.

During normal engine operation the solenoid valve 47 will be closed so that hydraulic fluid will flow past the check valve 67 and passageway 57 and enter the bore 59 behind piston 57*a* and simultaneously drive the slave piston 40 downwardly (as shown in FIG. 2B). The hydraulic fluid and spring 61 will drive the piston 57*a* downwardly (as shown in FIG. 2B) until the body of the piston 57*a* is fully extended against the snap ring 41, thereby maintaining the slave piston 40 in a position to produce the desired operating clearance or lash 87 (see FIG. 2B) in the valve train. Since the lash adjustment mechanism is hydraulic, zero lash may be provided during the powering mode, if desired. So long as the solenoid valve 47 is closed (i.e., deenergized) there is no drain path for the hydraulic fluid in bore 59 and therefore the piston 57*a* will remain in the extended position.

When the solenoid valve 47 is energized, the spool 77 is driven to the position shown in FIG. 2 so that the hydraulic pressure on both ends of the piston 57*a* is the same. When the hydraulic pressure in the conduit 28 is low, the slave piston return spring 44 will drive the slave piston 40 upwardly (as shown in FIG. 2) until it seats against the end of the adjustable stop 42 thereby producing a relatively large clearance 89 in the valve train.

It will be understood that the effect of the relatively large clearance 89 is to delay the beginning of the exhaust valve motion and to decrease the total valve travel. The decrease in valve travel is equal to the increase in the clearance or "lash".

The valve travel may also be affected by the relative diameters of the master piston and the slave piston. As the slave piston diameter is made smaller in relation to the master piston diameter, the travel of the slave piston will be increased. This effect will, of course, occur in both the positive power and retarding modes of engine operation.

It will be appreciated that the differential between the clearances 87 and 89 is determined by the extent to which the tip of the piston 57*a* extends outwardly from the adjustable stop 42 while both clearances can be adjusted simultaneously by adjusting the stop 42. As shown in FIGS. 2 and 2B, the check valve 45 is a separate valve communicating between fluid line 28 and the bore 59 of the adjustable stop 42. The check valve could also be combined with the piston 57*a* by providing, for example, an axial passageway through the piston 57*a* and seating a spring biased ball check valve at the end of such a passageway which adjoins the bore 59.

Simultaneously with the movement of the exhaust control valves 64 to the retarding position the intake control valves 72 are moved to the retarding position. Curve 90 (see FIG. 4) represents the motion of the intake valve for Cylinder No. 1 due to the action of the intake valve master piston for Cylinder No. 6. Curve 92 represents the motion of the intake valve for Cylinder No. 1 due to the action of its own master piston. The motion of the intake valve during retarding as indicated by curve 92 is less than that during powering as indicated by curve 84 since the output of the intake master cylinder is divided between the intake slave cylinders for Cylinder Nos. 1 and 6. It will be observed from FIG. 4 that a compression release event occurs during each revolution of the crankshaft for Cylinder No. 1. In like manner a compression release event occurs for each of the other engine cylinders during each revolution of the engine crankshaft.

It may be observed from FIG. 4 that the maximum travel of the intake valves occurs when the engine piston is about midway between its top dead center and bottom dead center positions and thus there is no problem of interference between the intake valves and the engine piston. However if the intake valves were to begin to open at the time they do during the powering mode they would open substantially simultaneously with the exhaust valves as shown by curves 84 and 88. This would provide an undesirable reverse flow through the intake valve and decrease the retarding horsepower developed by the engine by decreasing the mass flow rate of air through the engine, thereby reducing the turbine power and, consequently, the compressor power and speed and the intake manifold pressure. To avoid this problem, the timing of the intake valves should be delayed from the timing required for the powering mode. Such a timing delay can conveniently be provided by increasing the clearance or "lash" from the small lash 87' required for the powering mode (FIG. 3B) to an appropriate larger lash 89' (FIG. 3) during the braking mode.

Such a variation in the "lash" may be accomplished by a mechanism similar to that shown in FIGS. 2 and 2B. Referring to FIGS. 3 and 3B, the adjustable stop 42' is provided with an inner bore 59' within which a piston 57'*a* is mounted for reciprocating movement. The tip of piston 57'*a* extends beyond the end of the adjustable stop 42' adjacent the slave piston 40' and is biased toward the extended position against a snap ring 41' by a compression spring 61'. An annular groove 63' is formed on the exterior surface of the adjustable stop 42' and is of sufficient axial width to register with the passageway 57' throughout the range of adjustment of the adjustable stop 42'. A plurality of holes 65' are formed in the wall of the adjustable stop 42' in the region of the annular groove 63'.

Check valve 45' is located at the junction of passageways 51', 55' and 57' and comprises a ball valve 67' biased against a seat 69' formed in passageway 51' by a compression spring 71'. The compression spring 71' may conveniently be positioned in a threaded bore 73' which may be closed by a plug.

The solenoid valve 47' may comprise a solenoid coil 75' which actuates a spool 77' mounted for reciprocation in a bore 79' formed in the hydraulic overhead 22. An annular groove 81' is formed on the outer surface of the spool 77'. The spool 77' is biased in an upward direction (as shown in FIGS. 3 and 3B) by a compression spring 83'. Drain hole 85' leads to the engine sump. In its de-energized position as shown in FIG. 3B, the annular groove 81' of the solenoid valve spool 77' is not in registry with both passageways 53' and 55'. However, when the solenoid coil 75' is energized, the spool 77' will be driven to the position shown in FIG. 3 wherein the annular groove 81' is in registry with the passageways 53' and 55'.

The operation of the lash control mechanism shown in FIGS. 3 and 3B is similar to that shown in FIGS. 2 and 2B. During the powering mode (FIG. 3B) the solenoid valve 47' will be closed so that passageway 55' is disconnected from passageway 53'. Thus, oil or hydraulic fluid entering the bore 59' of the adjustable stop 42' through the check valve 45' will be trapped therein and the piston 57'a will be locked in its extended position so as to produce the small "lash" 87' required for the powering mode. During the retarding mode, (FIG. 3), the solenoid valve 47' will be energized and the passageways 53' and 55' connected through the spool 77'. Under these circumstances, the hydraulic pressure on each side of the piston 57'a will be equal and the slave piston 40' will be biased toward the end of the adjustable stop 42' by the slave piston spring 44' so as to produce the large "lash" 89' required for the retarding mode.

The action of the hydraulic overhead of the present invention is summarized in FIG. 5. FIG. 5 is a diagram showing the motion of the exhaust and intake valves for each cylinder during a complete engine cycle of 720°, or two crankshaft revolutions, for both the powering mode and the retarding mode of operation. The cylinders are listed, from top to bottom, in the firing order sequence. It will be seen that the pistons in Cylinders Nos. 1 and 6 reach TDC at 0° and 360° of crankshaft rotation and a compression release event is produced in each cylinder at about each TDC position. On the same scale, the pistons in Cylinder Nos. 5 and 2 reach TDC at 120° and 480° of crankshaft rotation and the pistons in Cylinder Nos. 3 and 4 reach TDC at 240° and 600° of crankshaft rotation. Thus two compression release events occur every 120° of crankshaft rotation.

The present invention has been described in connection with a six cylinder engine wherein a two-cycle retarding mode of action can be provided by interconnecting certain of the hydraulic valve actuating mechanisms. It will be appreciated that the principles disclosed herein may be applied to other four cycle engines having differing numbers of cylinders and different firing orders. This may most easily be done by preparing a diagram similar to FIG. 5 and then selecting the appropriate valve motions which will produce the desired two-cycle retarding mode from a four-cycle engine.

The terms and expressions which have been employed are used as terms of description and not of limitation and there is no intention in the use of such terms and expressions of excluding any equivalents of the features shown and described or portions thereof but it is recognized that various modifications are possible within the scope of the invention claimed.

What is claimed:

1. An hydro-mechanical overhead for a multi-cylinder four-cycle internal combustion engine having a camshaft, a plurality of intake valve pushtube means driven by said camshaft, a plurality of exhaust valve pushtube means driven by said camshaft, at least one intake and exhaust valve for each cylinder of said multi-cylinder internal combustion engine and a piston for each cylinder of said engine comprising an intake valve master piston means for each engine cylinder, each said intake valve master piston means driven by one of said intake valve pushtube means, an exhaust valve master piston means for each engine cylinder, each said exhaust valve master piston means driven by one of said exhaust valve pushtube means, an intake valve slave piston means for each engine cylinder, each said intake valve slave piston means adapted to open one of said intake valves, an exhaust valve slave piston means for each engine cylinder, each said exhaust valve slave piston means adapted to open one of said exhaust valves, adjustable stop means associated with each slave piston means, first passageway means interconnecting each said intake valve master piston means and each said intake valve slave piston means for each cylinder of said internal combustion engine, second passageway means interconnecting each said exhaust valve master piston means and each said exhaust valve slave piston means for each cylinder of said internal combustion engine, a plurality of three-way control valves, one of said three-way valves interposed in each of said first and second passageways, said control valves having a powering position wherein each said master piston means communicates with said slave piston means of a first engine cylinder with which both said master and said slave piston means are associated, said control valves associated with said intake valve master piston means having a retarding position wherein each said intake valve master piston means communicates with said slave piston means associated with said first engine cylinder and also through third passageway means with the intake slave piston means of a second engine cylinder having a piston which is about 360 crankangle degrees out of phase with the piston of said first engine cylinder, said control valves associated with said exhaust valve master piston means having a retarding position wherein each of said exhaust valve master piston means associated with said first engine cylinder communicates through fourth and fifth passageway means with the exhaust slave piston means of third and fourth engine cylinders having pistons which are respectively in their compression and exhaust strokes when said piston in said first cylinder is in its expansion stroke, means to provide hydraulic fluid to each of said passageways and each of said master and slave piston means, control means to move each of said control valves between the said powering and retarding positions, lash adjusting means associated with each of said adjustable stop means and having powering and retarding positions, and means controlling said lash adjusting means to the same position as the position of said control valves.

2. An hydro-mechanical overhead as set forth in claim 1 wherein the internal combustion engine has 6 cylinders and a cylinder firing order of 1, 5, 3, 6, 2, 4 and wherein when said first cylinder is Cylinder No. 1, said second cylinder is Cylinder No. 6, said third cylinder is Cylinder No. 3 and said fourth cylinder is Cylinder No. 4; when said first cylinder is Cylinder No. 5, said second cylinder is Cylinder No. 2, said third cylinder is Cylinder No. 6 and said fourth cylinder is Cylinder No. 1; when said first cylinder is Cylinder No. 3, said second cylinder is Cylinder No. 4, said third cylinder is Cylinder No. 2 and said fourth cylinder is Cylinder No. 5; when said first cylinder is Cylinder No. 6, said second cylinder is Cylinder No. 1, said third cylinder is Cylinder No. 4 and said fourth cylinder is Cylinder No. 3; when said first cylinder is Cylinder No. 2, said second cylinder is Cylinder No. 5, said third cylinder is Cylinder No. 1 and said fourth cylinder is Cylinder No. 6; and when said first cylinder is Cylinder No. 4, said second cylinder is Cylinder No. 3, said third cylinder is Cylinder No. 5 and said fourth cylinder is Cylinder No. 2.

3. An hydro-mechanical overhead as set forth in claim 1 wherein said lash adjusting means comprises an hydraulically actuated piston extendible from said adjustable stop means, sixth passageway means communicating between said adjustable stop means and said first or second passageway means, and check valve means communicating between said adjustable stop means and said first or second passageway means.

4. An hydro-mechanical overhead as set forth in claim 3 wherein said check valve means is located in said sixth passageway.

5. An hydro-mechanical overhead as set forth in claim 1 wherein said means controlling said lash adjusting means comprises a valve positioned in a seventh passageway communicating between said adjustable stop means and said first or second passageway means.

6. An hydro-mechanical overhead as set forth in claim 5 wherein said valve positioned in said seventh passageway is a solenoid actuated valve.

7. An hydro-mechanical overhead as set forth in claim 2 wherein said lash adjusting means comprises an hydraulically actuated piston extendible from said adjustable stop means, sixth passageway means communicating between said adjustable stop means and said first on second passageway means, and check valve means communicating between said adjustable stop means and said first or second passageway means.

8. An hydro-mechanical overhead as set forth in claim 7 wherein said check valve means is located in said sixth passageway.

9. An hydro-mechanical overhead as set forth in claim 2 wherein said means controlling said last adjusting means comprises a valve positioned in a seventh passageway communicating between said adjustable stop means and said first or second passageway means.

10. An hydro-mechanical overhead as set forth in claim 9 wherein said valve positioned in said seventh passageway is a solenoid actuated valve.

* * * * *